United States Patent [19]

Palmer

[11] Patent Number: 4,787,584

[45] Date of Patent: Nov. 29, 1988

[54] TRASH BAG SUPPORTING DEVICE

[76] Inventor: David Palmer, 6539 Varnum Way, Northhighlands, Calif. 95660

[21] Appl. No.: 166,997

[22] Filed: Mar. 11, 1988

[51] Int. Cl.[4] ..... B65B 67/04

[52] U.S. Cl. ..... 248/99; 15/257.9; 141/108; 141/391; 248/101; 248/222.1

[58] Field of Search ..... 248/95, 97, 98, 99, 248/101, 222.1, 551, 553; 15/257.1, 257.9; 141/108, 314, 391; 294/55; 403/330

[56] References Cited

U.S. PATENT DOCUMENTS

| | | | |
|---|---|---|---|
| 122,060 | 12/1871 | Richardson | 49/465 |
| 1,266,522 | 5/1918 | Oldham | 141/314 X |
| 2,422,084 | 6/1947 | Dorner | 248/222.1 X |
| 2,938,696 | 5/1960 | Hinshaw | 248/215 |
| 3,180,384 | 4/1965 | Seifert | 248/95 X |
| 3,697,030 | 10/1972 | Schultz | 15/257.1 |
| 3,754,785 | 8/1973 | Anderson | 294/55 X |
| 3,891,172 | 6/1975 | Einhorn | 248/221. X |
| 4,048,691 | 9/1977 | Spangler | 294/55 X |
| 4,159,139 | 6/1979 | Gawedzinski | 248/101 X |
| 4,193,157 | 3/1980 | Large | 15/257.1 |
| 4,196,928 | 4/1980 | Spangler | 294/55 |
| 4,312,531 | 1/1982 | Cross | 15/257.1 |
| 4,411,300 | 10/1983 | Rico | 15/257.1 |
| 4,470,627 | 9/1984 | Carroll | 15/257.1 |
| 4,488,697 | 12/1984 | Garvey | 248/97 X |
| 4,659,045 | 4/1987 | Flynn | 248/99 |
| 4,664,348 | 5/1987 | Corsaut | 15/257.1 |
| 4,723,803 | 2/1988 | Sapp | 294/55 |

FOREIGN PATENT DOCUMENTS

| | | | |
|---|---|---|---|
| 495382 | 11/1938 | United Kingdom | 248/222.1 |

*Primary Examiner*—Ramon S. Britts
*Assistant Examiner*—David L. Talbott
*Attorney, Agent, or Firm*—Poms, Smith, Lande & Rose

[57] ABSTRACT

A two piece portable and upright trash bag supporting device having a frame member removably retaining the open end of a conventional flexible trash bag to an opening in an upright unit. The unit has an inclined ramp leading into the unit opening and, thus, into the bag. A handle is provided at the upper end of the unit for holding the same while sweeping trash, leaves, grass and other debris into the bag. After filling the bag, the frame member and attached bag is removed from the unit, the frame member is removed from the bag and the bag is discarded.

8 Claims, 1 Drawing Sheet

Fig. 1.
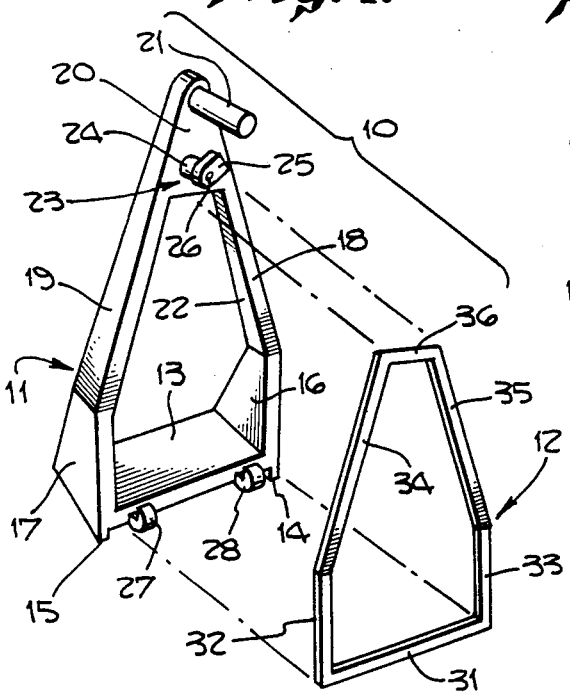
Fig. 2.
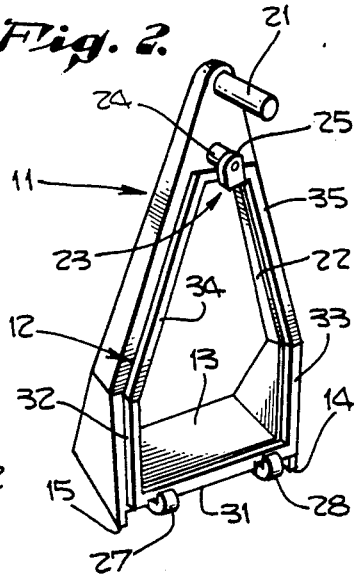
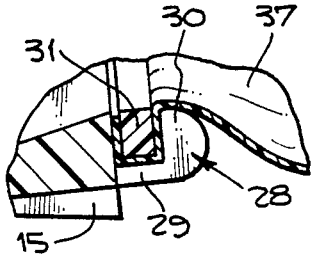
Fig. 5.
Fig. 3.
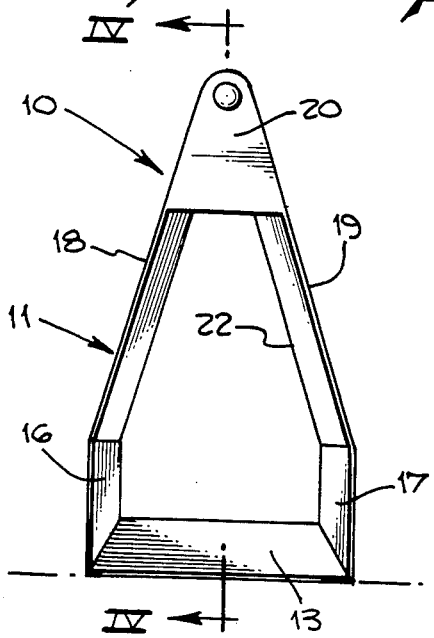
Fig. 4.
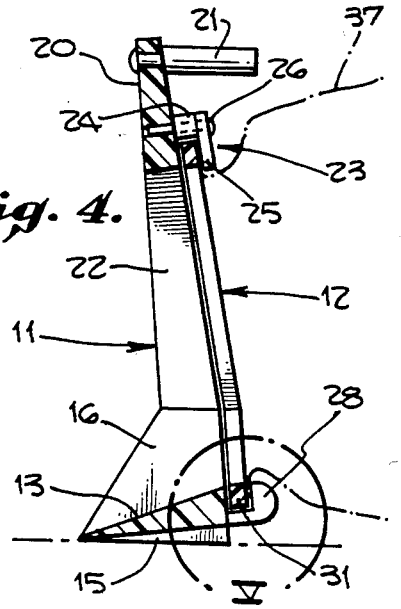

TRASH BAG SUPPORTING DEVICE

BACKGROUND OF THE INVENTION

1. Field of the Invention

The invention relates to trash bag holders; and, more particularly, to apparatus for holding open or retaining a trash bag in an open position for assisting in filling the same.

2. Description of the Prior Art

Plastic trash bags are well known in the art and are usually filled with trash, leaves, grass clippings and other debris. Various devices have been suggested in the prior art for supporting such bags in a position where they can be filled. For example, in U.S. Pat. No. 4,664,348 to Corsaut et al, a bag holder is disclosed. However, there is no support for the bag and it is not convenient to use. In U.S. Pat No. 4,411,300 to Rico, a two piece frame is secured to a bag (FIG. 2) and this frame can be attached to the hip of the user. In FIGS. 7 and 8, it is disclosed that this frame can be snap fit into a scoop with a sloped surface. However, there is no vertical support and no handle. The user must stoop to use the device.

In U.S. Pat. No. 4,312,531 to Cross, a scoop 28 attachable to a bag is provided but again the scoop is used in the position shown in FIG. 5 and, thus, one must stoop to use it.

In U.S. Pat. No. 4,193,157 to Large, a device similar to Cross is disclosed. A hoop with spikes to hold it in the ground (FIG. 5) is used to hold a bag, an incline 34 being optionally provided; however, one must stoop to use it. In U.S. Pat. No. 3,697,030 to Schultz, apparatus similar to Large is provided (FIG. 1) but without an inclined ramp.

In U.S. Pat. No. 4,659,045 to Flynn, an arcuate frame is shown with an inclined guide and a bag (FIG. 4) attachable thereto. There is no vertical support. In U.S. Pat. No. 3,754,785, a bag holder is shown with an upwardly extending handle 18. There is no stable upright support.

There thus exists a need for a device for quickly and easily attaching a conventional trash bag thereto, holding the bag open, filling the bag with sweepings while remaining erect, and detaching the bag for disposal after filling.

SUMMARY OF THE INVENTION

It is an object of this invention to provide apparatus for supporting a trash bag for convenient filling while remaining erect.

It is still another object of this invention to provide a stable upright support for holding open the open end of a trash bag for filling the same with an inclined ramp leading into the open end.

It is still further an object of this invention to provide such a support which can be used as a cane while picking up leaves and other debris.

These and other objects are preferably accomplished by providing a two piece portable and upright trash bag supporting device having a frame member removably retaining the open end of a conventional flexible trash bag to an opening in an upright unit. The unit has an inclined ramp leading into the unit opening and, thus into the bag. A handle is provided at the upper end of the unit for holding the same while sweeping trash, leaves, grass and other debris into the bag. After filling the bag, the frame member and attached bag are removed from the unit, the frame member is removed from the bag and the bag is discarded.

BRIEF DESCRIPTION OF THE DRAWING

FIG. 1 is an exploded view of a trash bag supporting device in accordance with the teachings of this invention;

FIG. 2 is a rear perspective view of the assembled parts of the device of FIG. 1;

FIG. 3 is a front vertical view of one part of the device of FIGS. 1 and 2;

FIG. 4 is a view taken along lines IV—IV of FIG. 3; and

FIG. 5 is a view taken along lines V—V of FIG. 4.

BRIEF DESCRIPTION OF THE PREFERRED EMBODIMENT

Referring now to FIG. 1 of the drawing, a trash bag supporting device 10 is shown in exploded view comprised of two parts, a first main upright bag support unit 11 and a bag retaining frame member 12. Unit 11 includes a ramp or base 13 having a pair of spaced triangular-shaped downwardly extending flanges 14, 15 on the underside thereof. These flanges 14, 15 taper from the front of unit 11 to the rear thereof (FIG. 4) thus providing a sloped surface to the upper surface of base 13 as seen in FIG. 4. Unit 11 includes a pair of spaced side walls 16, 17 (FIG. 3) integral with and extending upwardly from each side of base 13, each wall 16, 17 being generally triangular (FIG. 1) and having an integral arm portion 18, 19, respectively extending inwardly toward the central longitudinal axis of unit 11 to a generally triangularly shaped apex portion 20 (FIG. 3). As seen in FIG. 1, a handle 21 is integral with an extends rearwardly from apex portion 20 and, as seen in FIG. 4, is angled slightly downwardly. Also, as seen in FIG. 3, the area 22 between apex portion 20, arm portions 18, 19, side members 16, 17 and base 13 is open as indicated by opening 22.

As seen in FIG. 1, a rotatable latch member 23 is disposed on the rear wall of apex portion 20 at the top of opening 22 having a generally cylindrical pin 24 (FIG. 4) with an integral flat latch portion 25 extending normal to the central axis of pin 24. Pin 24 is rotatably secured to unit 11 by a pin 26. As seen in FIGS. 1, 2 and 4, a pair of spaced flange members 27, as are provided at the bottom of unit 11 at the rear of base member 13. Each flange member 27, 28 includes a first portion 29 (FIG. 5) integral with and extending outwardly and rearwardly of base member 13, then curving upwardly and spaced from base member 13 to form a curved locking flange portion 30 as seen in FIG. 5.

Frame member 12 (FIG. 1) has an elongated base portion 31, a pair of integral upstanding elongated side members 32, 33 and a pair of integral upwardly and inwardly extending elongated members 34, 35 which meet at apex portion 36. The plane of members 34, 35 (FIG. 4) is at an angle with respect to the plane of members 32, 33 so that the side contour of frame member 12 follows the rear contour of unit 11 as seen at the right side thereof in FIG. 4. Also, the dimensions of frame member 12 are related to the dimensions of the area surrounding opening 22 of unit 11. That is, the overall width of members 32, 33 is slightly greater than the overall width of opening 22 adjacent side members 16, 17; the thickness of frame member 12 and the overall height of frame member 12 are such that elongated portion 31 snaps into the spacing between curved flange portions 30 and the rear wall of unit 11, as seen in FIG. 5, with apex portion 36 being retained to unit 11 by rotation of latch member 23 to the position shown in FIG. 4 thereby retaining frame member 12 to unit 11.

A conventional large waste or trash bag 37 is first secured to frame member 12. Of course, frame member 12 can be sized to accommodate all sizes of trash or leaf bags. Thus, the circumference of frame member 12 is generally related to the circumference of the opening leading into a conventional trash bag so that the frame member 12 is placed over the outside of the peripheral edge of the bag and this edge is turned out, over and under the frame member 12. Frame member 12, with the trash bag 37 in position thereon, is now mounted to support unit 11. This can be seen in FIG. 4 wherein the bag 37 is partially shown in dotted lines. It can be seen that elongated portion 31 of frame member 12 is inserted between flange members 27, 28 and the rear wall of unit 11, the curved locking flange portions 30 serving to retain frame member 12 in position. The upper apex portion 36 is disposed against the rear wall of apex portion 20 and latch member 23 is rotated about pin 24 (FIG. 4) to a position whereby latch portion 25 extends downwardly, as seen in FIG. 4, trapping apex portin 36 therebetween.

The device 10 is thus set up as seen in FIG. 4. The operator grasps handle 21 and brushes or rakes leaves or other debris up ramp or base 13 and into the open end of bag 37. The handle 21 and firm support allows the operator to stand erect so that device 10 is to be used much like a cane. When filled, the device 10 can be laid down with the open end of the bag 37 extending upwardly. The frame member 12 can now be removed, the bag 37 is removed from the frame member 12, and the bag 37 tied and discarded, or emptied and reused.

Although particular securing means have been provided for detachably securing frame member 12 to unit 11, any suitable means, such as magnetic means, may be provided. The flange members 27, 28 and latch member 23 allows quick and easy alignment of the bag 37 to the unit 11. The entire device 10 is free standing and stable, even when full. The slight forward tilt (FIG. 4) assists in such stability. The straight side walls 16, 17, along with the inwardly angled walls 18, 19, allow device 10 to be placed flush against a side wall, such as the side of a house or along a fence, to sweep leaves and other debris therein.

The device 10 can also be used by laying it on the ground so that handle 21 rests on the horizontal ground surface. The bag 37, attached thereto, is thus underneath device 10 between it and the ground. Leaves and other debris can be placed inside of bag 37 and about the opening leading into the bag 37; merely picking up the device 10 by handle 21 allows the debris to fall into bag 37.

Any suitable materials, such as various plastics, wood, metals, etc., may be used. Any suitable dimensions may be used. For example, the overall height of unit 11 may be about 27" and the overall width about 15". The overall height of walls 16, 17 may be about 10"and the overall length of walls 18, 19 (from walls 16, 17 to the tip of apex portion 20) may be about 21". The overall depth of unit 11 may be about 9½" and the height of flanges 14, 15 at the wider end thereof may be about 2". This gives a desired angle of tilt or slope to ramp 13.

Of course, any suitable size device may be used. For example, a smaller unit adapted to accommodate smaller waste basket-type bags may be provided. The device is simple to use and can be used without bending. It can be used over and over. Suitable indicia can be placed on either unit 11 or frame member 12, or on both, to accommodate proper alignment.

There is thus disclosed a unique trash bag supporting device allowing the user to quickly and easily fill trash bags with grass, leaves and other debris, then allow easy and quick removal of the filled trash bags.

I claim:

1. A two piece portable, stable and upright trash bag supporting device comprising:

an upright right main support member including a base support having a lower planar surface adapted to rest on a supporting surface and an inclined ramp portion on its upper surface;

said main support member further including a pair of upwardly extending vertical side walls on each side of said base support, a first upwardly and inwardly extending wall member integral with one of said pair of side walls and a second upwardly and inwardly extending wall member integral with the other of said pair of side walls, said wall members meeting to form an apex portion with an opening through said device defined by said apex portion, said wall members, said side walls and said base support with said ramp portion leading into the bottom of said opening; and a detachable vertically upright frame member having a central opening and a peripheral structure surrounding said central opening similar to said first mentioned opening of a dimension generally related to the boundaries of said first mentioned opening and a seperate locking means for detachably locking the frame member to said main support member, said side walls and said base support so that an open area is provided through both said frame member and said main support member, said open are being provided by the alignment of both said openings.

2. In the device of claim 1 wherein a handle extends rearwardly from said apex portion.

3. In the device of claim 2 wherein the longitudinal axis of said handle is at an angle less than 90° with respect to the plane of said apex portion.

4. In the device of claim 1 including a pair of spaced flange members generally triangular in configuration mounted on the underside of said base support having their apices at the narrowest point of the slope of said ramp portion.

5. In the device of claim 1 wherein the plane of said wall members is at an angle with respect to the vertical.

6. In the device of claim 1 wherein the plane of said wall members angles toward the narrowest point of the slope of said ramp portion.

7. In the device of claim 1 wherein said frame member is detachably mounted to said base support by a pair of spaced lips on the rear wall of said base support and by a pivotally mounted latch member on the rear wall of said apex portion.

8. In the device of claim 1 wherein said frame member includes an elongated bottom rail, a pair of spaced upright side rails mounted to opposite ends of said bottom rail and a pair of inwardly extending inclined rails integral with said side rails meeting at an apex portion

* * * * *